US006014867A

United States Patent [19]

Fløysvik

[11] Patent Number: 6,014,867

[45] Date of Patent: Jan. 18, 2000

[54] REFRIGERATING COUNTER WITH DRAWERS

[75] Inventor: Jan Egil Fløysvik, Sandnes, Norway

[73] Assignee: AB Electrolux, Stockholm, Sweden

[21] Appl. No.: 09/011,430

[22] PCT Filed: Aug. 16, 1996

[86] PCT No.: PCT/NO96/00208

§ 371 Date: Feb. 10, 1998

§ 102(e) Date: Feb. 10, 1998

[87] PCT Pub. No.: WO97/06715

PCT Pub. Date: Feb. 27, 1997

[30] Foreign Application Priority Data

Aug. 16, 1995 [NO] Norway ..... 953211

[51] Int. Cl.[7] ..... A47F 3/04

[52] U.S. Cl. ..... 62/255; 62/414

[58] Field of Search ..... 62/255, 407, 413, 62/414, 419

[56] References Cited

U.S. PATENT DOCUMENTS

| | | | |
|---|---|---|---|
| 2,208,936 | 7/1940 | Olin . | |
| 2,962,875 | 12/1960 | Barroero . | |
| 2,986,019 | 5/1961 | Happer . | |
| 3,090,211 | 5/1963 | Barroero . | |
| 3,115,019 | 12/1963 | Rutishauser . | |
| 3,168,818 | 2/1965 | Weber | 62/414 |
| 3,261,173 | 7/1966 | Gould . | |
| 3,306,068 | 2/1967 | Allgeyer et al. . | |
| 3,364,694 | 1/1968 | Cohen et al. | 62/419 |
| 3,365,907 | 1/1968 | Barroero . | |
| 3,769,805 | 11/1973 | Corini . | |
| 4,267,706 | 5/1981 | Abraham . | |
| 4,314,458 | 2/1982 | Hade et al. . | |
| 4,373,355 | 2/1983 | Monroe . | |
| 4,777,806 | 10/1988 | Perez . | |
| 5,058,393 | 10/1991 | Callon et al. . | |
| 5,301,517 | 4/1994 | Bustos | 62/255 |
| 5,461,878 | 10/1995 | Moore et al. | 62/255 |
| 5,499,513 | 3/1996 | Bustos | 62/255 |
| 5,704,224 | 1/1998 | Choi | 62/407 |

FOREIGN PATENT DOCUMENTS

| | | |
|---|---|---|
| 582940 | 2/1994 | European Pat. Off. . |
| 1271194 | 7/1961 | France . |
| 1295475 | 5/1962 | France . |
| 2026031 | 9/1970 | France . |
| 2744943 | 4/1979 | Germany . |
| 3703610 | 8/1988 | Germany . |
| 2028480 | 3/1990 | United Kingdom . |
| 95/21560 | 8/1995 | WIPO . |
| 97/00038 | 1/1997 | WIPO . |

*Primary Examiner*—William E. Tapolcai
*Attorney, Agent, or Firm*—Andrus, Sceales, Starke & Sawall

[57] ABSTRACT

A refrigerating counter for continuous cooling of bottles containing beverages comprises a cooling apparatus as well as means for supplying cold air to said bottles to be cooled. It is intended to offer the bottles more immediately for sale and to bring the bottles, from a "higgledy-piggledy" stacking rearmost within the cabinet, to move forwardly to a bottle take out place. The refrigerating counter comprises a plurality of vertically staggered drawers (10) for the accommodation of the bottles as a disorderly mass. The drawers (10) in the refrigerating counter (12) each has an upwardly open portion constituting the take out place for the bottles, at the front side of the counter (12). In order not to cover said take out place of one drawer by the overlying drawer (10) in a vertical column of drawers (10), the foremost, upper portion of each drawer (10) slopes downwardly/forwardly.

6 Claims, 5 Drawing Sheets

REFRIGERATING COUNTER WITH DRAWERS

BACKGROUND OF THE INVENTION

This invention relates to a refrigerating counter, particularly for continuous cooling of bottles and cans, preferably containing beverages, comprising cooling apparatus and cold air supply to said bottles, cans, etc. to be cooled.

The cold air supply may be based on natural and/or forced supply, and the same applies to the removal of warmer air which has accepted heat from the bottles, etc. and which, in a first removal step, is superseded by the supplied cold air. In forced supply/removal, usually fans are used. Natural movement of air presupposes that hot air rises, while cold air will sink. These principles are well known and in general use in i.a. refrigerating counters.

One conventional refrigerating counter design which constructively and functionally has been built up with a view to cool especially beverages in bottles and cans, is represented by cupboard-like refrigerating counters having front glass door(s) and rearwardly positioned shelves, the socalled cupboard or cabinet coolers. Here, bottles and/or cans are arranged in an upright position on horizontal shelves, offered for sale.

A problem of these cabinet coolers for beverages in bottles and/or cans is that the act of opening the cabinet door represents a psychological "barrier" for a possible buyer of cold beverage. Another problem is that the cabinet/shelf arrangement invites the purchaser to take the bottle/can standing closest to the opened cabinet door, and which often is the one placed into the cabinet last and which, consequently, is not cooled or only insufficiently cooled. This causes that the oldest and, thus, coldest bottle/can, will be left untouched hindmost in the cabinet. Other customers will be liable to rummage within the cabinet and to overturn bottles and/or cans while trying to find a bottle/can which is cold. Often, the attendants are brought upon extra work, displacing cold bottles from the inner shelf portions and placing them foremost.

SUMMARY OF THE INVENTION

It is an object of the present invention to find a simple solution to these problems and, thus, provide a refrigerating counter, especially for bottles and/or cans, preferably containing beverages, wherein the bottles/cans lie more immediately offered for sale than in the above mentioned cabinet coolers; wherein measures have been taken in order to secure movements in the bottle/can mass so that the respective bottles/cans circulate from a less visible filling position for recently fed in, not cooled bottles/cans to an easily visible take out (removal) position for cooled bottles/cans. Said circulation should be caused naturally, i.e. that the bottles/cans are desired to be moved due to the fact that one or more bottles/cans are removed by a customer. Thus, the coldest bottles, etc. will be found at the most conspicuous place of the refrigerating counter, namely the take out place for the bottles/cans, from where they are removed by the customer and effect new movements in the remaining bottle/can mass.

Said object is achieved in that the refrigerating counter is such shaped and designed that it exhibits the features as defined in the claims.

The following sub claims define advantageous features of embodiments which are conformable and uniform with the invention according to the main claim.

A refrigerating counter shaped and designed in accordance with the apparatus of claim 1, comprises one, but preferably more drawers for occasional, disorderly accommodation (helter-skelter, resting supportingly against each other while exhibiting varying longitudinal axis slope) of bottles, cans and other containers or other goods to be cooled (meat, fish, vegetables, fruit and berries in portion packages), and formed with an upwardly open front portion forming the place where to take out the bottles, etc.—"the take out place".

In order to secure a natural displacement of e.g. bottles which in uncooled condition are placed innermost within a drawer, ahead in a direction forwardly towards the upwardly open front portion of the drawer, where the bottles lie offered for sale and where said take out place of the refrigerating counter is formed, from where the customers choose between bottles in cooled condition, the drawer bottom should, preferably, slope downwardly in a direction forwardly from behind.

Such a drawer bottom slope is also advantageous with a view to the supply of cold air from the cooling apparatus of the refrigerating counter, where said drawer bottom, on which the bottles rest, may constitute a loose (separate) member in the respective drawer where, between the loose bottom and the lower, outer bottom, a prism-like chamber is formed. This chamber may advantageously be divided by means of two partitions extending parallel to the longitudinal direction of the drawer, said partitions, thus, dividing the chamber in the drawer below the loose bottom into three sub chambers, of which the central one receives the cold cooling air from the cooling invention of the refrigerating counter by means of a fan, while each of the two outer sub chambers serves to conduct away "used" cooling air which has accepted heat from bottles, drawer, etc., through fans.

Through through-going holes and pipe stubs, each sub chamber is in communication with broad channels exhibiting a large flow area and a great length, formed at the rear side of the refrigerating counter.

Appropriately, the loose bottom part of the drawer is formed with through-going holes at each side in the rear portion thereof, allowing warmer air to flow out into the underlying drawer part's to sub chambers at the sides thereof, while it is formed with through-going holes along the front edge thereof, allowing cold cooling air to flow in from the underlying drawer part which, in addition to its through-going holes in the rear wall co-operating with pipe studs in the rear wall of the refrigerating counter immediately in front of the flow channels, has through-going holes adjacent its front bottom portion between the partitions, i.e. in the sub chamber carrying cold cooling air. These holes in the fixed bottom of the drawer part create a certain leakage downwardly from above to the take out portion of the underlying drawer, cold air, thus, (because it is heavier than warm air) sinks from the uppermost to the lowermost drawer of an assumed drawer arrangement, the drawers being positioned in a vertical row. The drawers may be placed in horizontal and/or vertical rows. In a drawer arrangement wherein drawers are placed one above the other, a customer taking out a bottle from an intermediate drawer or the lowermost drawer, will feel this pleasant cold air leak against his hand, and the article will feel chilly.

The drawer part and the loose drawer bottom part enable a simplified cleaning of the drawers. Packings or similar sealing means may be disposed between the two loose parts of each drawer.

It would highly facilitate filling of one or more drawers of the refrigerating counter if the drawer or each drawer, respectively, is disposed displaceably on lying rails, such that it can be pulled out for filling, the filling normally taking place in the rear portion of the drawer, whereafter the drawer is pushed in into normal position, where each drawer's upwardly open front portion, the take out place, is exposed and freely accessible. The side walls of this take out portion is, at the upper portion thereof, preferably chamfered such that they slope downwardly from the inside/outwardly respectively from behind/forwardly, and the lower portion of the side walls may have an opposite slope, so that they extend slopingly upwardly from behind/forwardly.

It will be practical to dispose at least one stop for each drawer, so that the respective drawer is stopped upon maximum extension. Upon full extension of the drawers, during shipment or cleaning, the stops should possibly be capable of being put out of function.

The loose drawer bottom could carry vertical partitions, thereby allowing various types of bottled or canned beverages in the same drawer.

BRIEF DESCRIPTION OF THE SEVERAL VIEWS OF THE DRAWING

An exemplary embodiment of a refrigerating counter shaped and designed in accordance with the present invention is further explained in the following with reference to the drawings, in which.

DETAILED DESCRIPTION OF THE INVENTION

Figure 1:
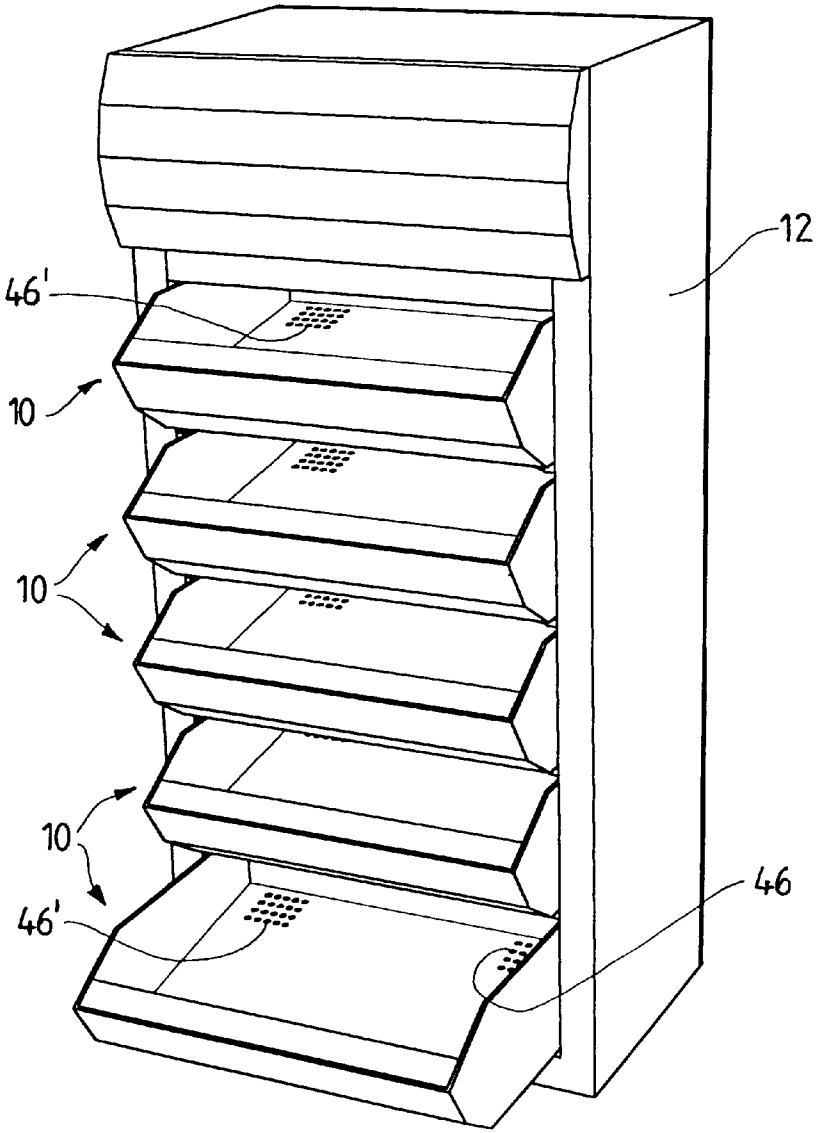
FIG. 1 shows a perspective view of a refrigerating counter according to the invention having five drawers arranged in one vertical row, seen obliquely from ahead.
Figure 2:
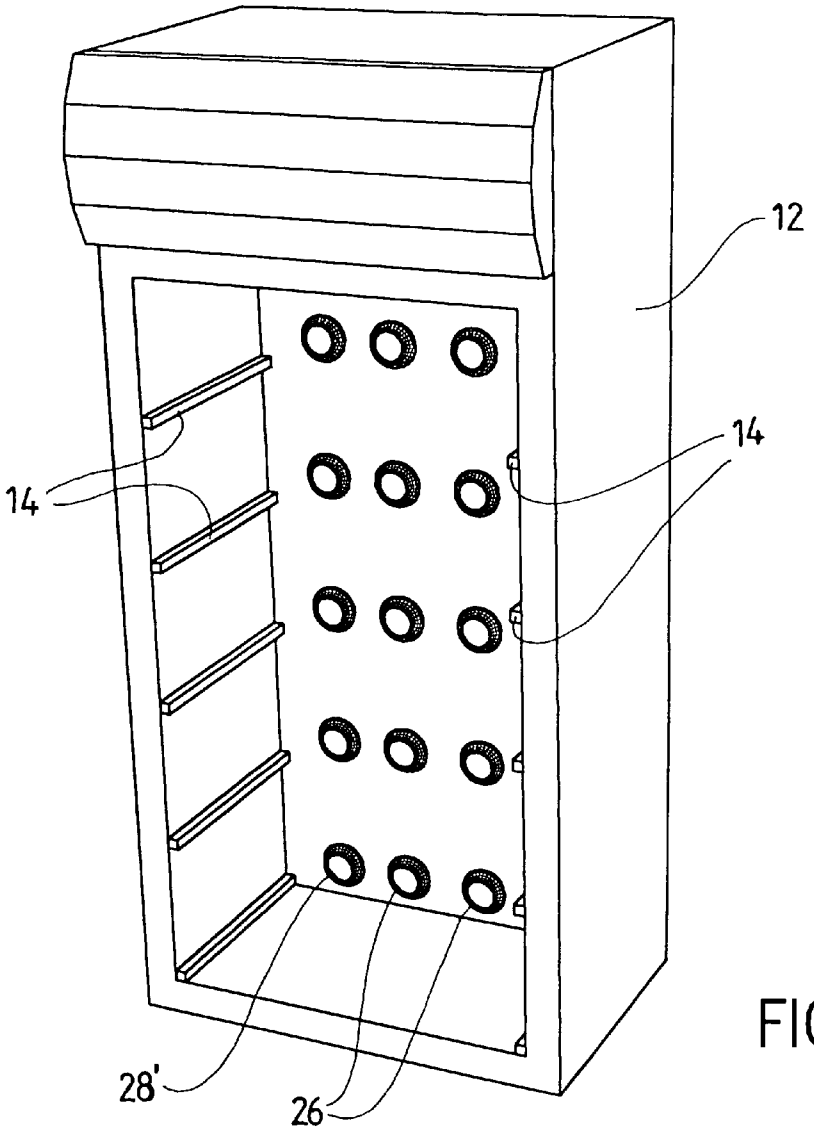
FIG. 2 shows in a perspective view the refrigerating counter of FIG. 1, seen from ahead, and with the five drawers removed in order to show their sliding rails and a number of pipe studs for the supply of cold air and for the withdrawal of warmer air, said pipe studs being intended to be interconnected with through-going holes in the respective drawer's rear wall and communicate with vertical channels in the rear part of the refrigerating counter.
Figure 3:
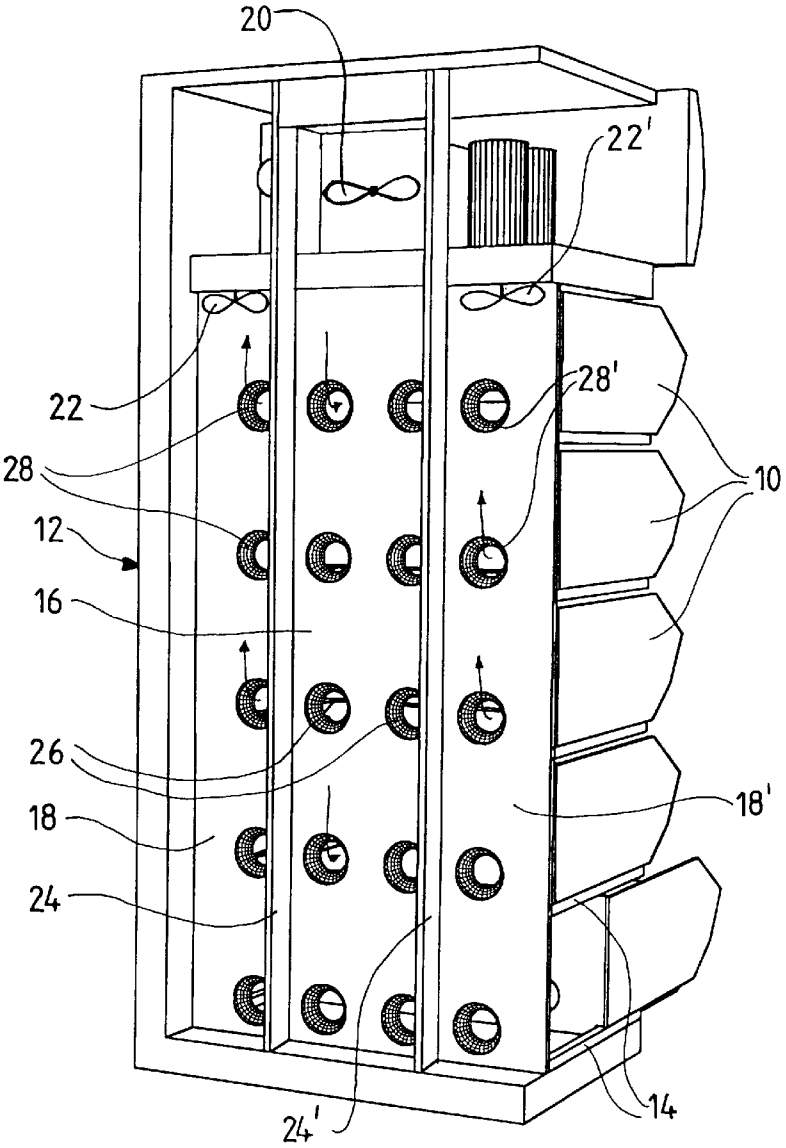
FIG. 3 shows a perspective view of the refrigerating counter of FIGS. 1 and 2, seen from behind, a rear cover being removed, in order to show said pipe studs and their communicating vertical channels for cold air in the middle, and for warmer, consumed cooling air, laterally.

First, reference is made to FIGS. 1–3 showing a refrigerating counter according to the invention in the form of a drawer arrangement in one vertical row. A refrigerating counter according to the invention may in two extreme cases comprise (1) one single drawer 10, and (2) a plurality of drawers 10 placed in vertical and/or horizontal rows.

According to the exemplary embodiment, five parallel drawers 10 are disposed in a cabinet-like cooling furniture 12. Each drawer is adapted to be pulled out and pushed in individually along substantially horizontal sliding rails 14, FIG. 2, and stops (not shown) assigned to each drawer 10, normally attend to stoppage of the respective drawer upon taking a maximum pulled out position, such as e.g. represented by the lowermost drawer in FIG. 1.

At the rear side thereof, FIG. 3, where the rear cover is removed, the cabinet has a channel system consisting of a central, broad, vertical channel 16 for downwards transport of cold air to the each single drawer 10, and two narrower, vertical, lateral channels 18, 18' for upwards transport of "partly consumed" cooling air which has accepted heat from the goods (not shown) to be cooled and which, in a first phase of withdrawal, has been displaced by cold cooling air supplied to each single drawer. This phenomenon will be described more in detail in connection with the shape, design and function of each single drawer. In accordance with the examplary embodiment, the flows downwards and upwards within the channels 16 and 18, 18' can be effected by means of mutually independent fans 20 and 22, 22'. Two vertical partitions between these air flow channels 16, 18, 18' are denoted at 24, 24' in FIG. 3.

A cooling apparatus of a type known per se and which is not the subject matter of the present invention may, in the examplary embodiment shown, be disposed in the upper portion of the cabinet 12. However, in principle, there is nothing to prevent the positioning of the cooling apparatus within the bottom part of the cabinet 12—then in connection with another embodiment.

In the front restriction wall 16*a*, 18*a*, 18*a'* of the air flow channels 16, 18, 18', pipe studs 26, 28, 28' have been disposed, each of which has a conically tapering course in the forward direction. Each pipe stud 26, 28, 28' corresponds to a through-going hole 30, 32, 32' in the rear wall 34 of a drawer 10, see FIGS. 4 and 5.

When a drawer's 10 rear wall holes 30, 32, 32' are brought to surround pipe studs 26, 28, 28' assigned thereto in a horizontal row, minimum leakage of cold cooling air takes place, said cold cooling air being supplied to the drawer, and warmer air in the course of being removed from the drawer 10, being displaced by the supplied cold air as well as being influenced by the suction fans 22, 22'.

Figure 4:
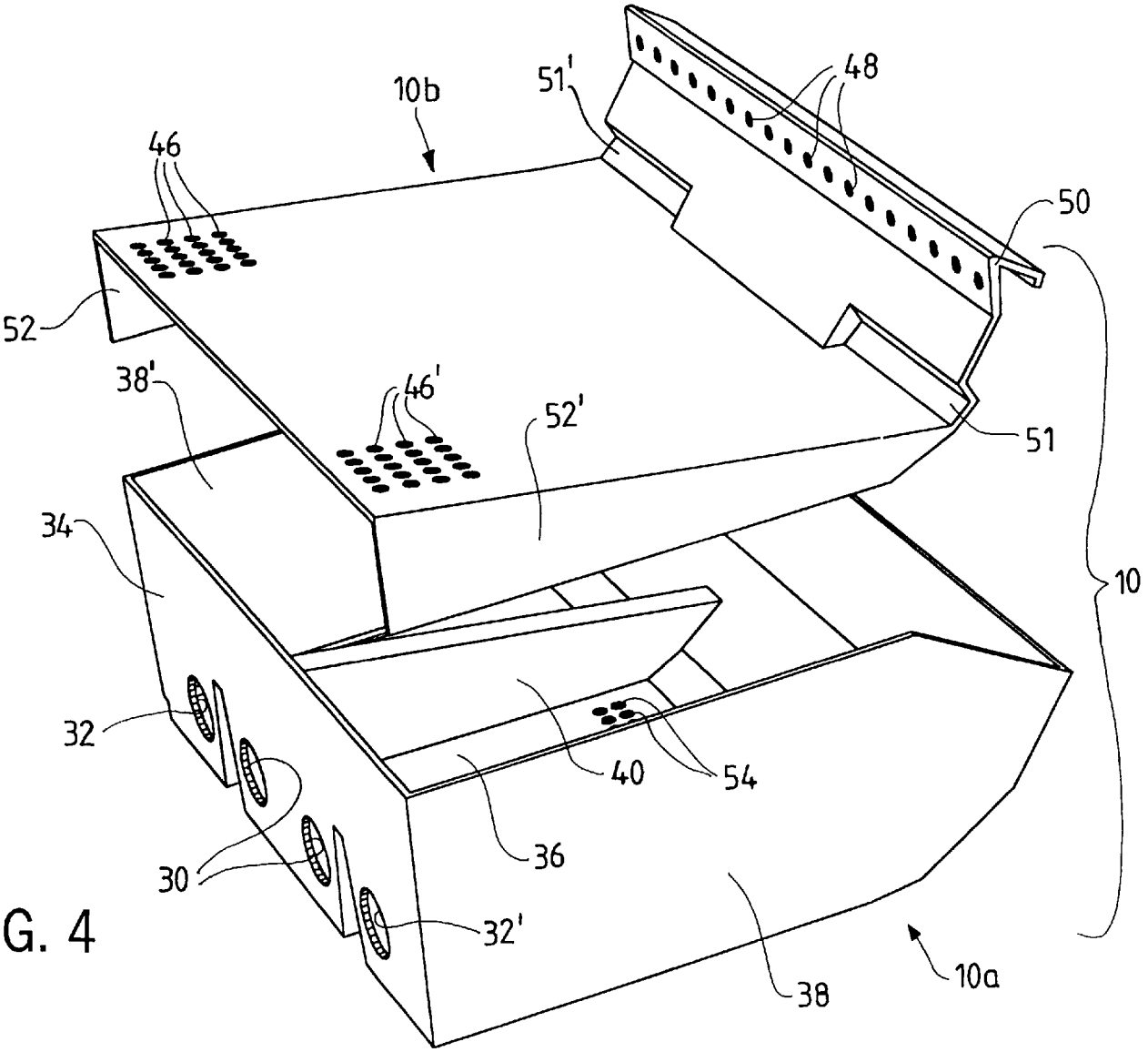
FIG. 4 shows a perspective exploded view of one drawer's two loose parts, where the upper represents the loose bottom and the lower one the drawer body with the fixed bottom thereof, seen obliquely from behind.
Figure 5:
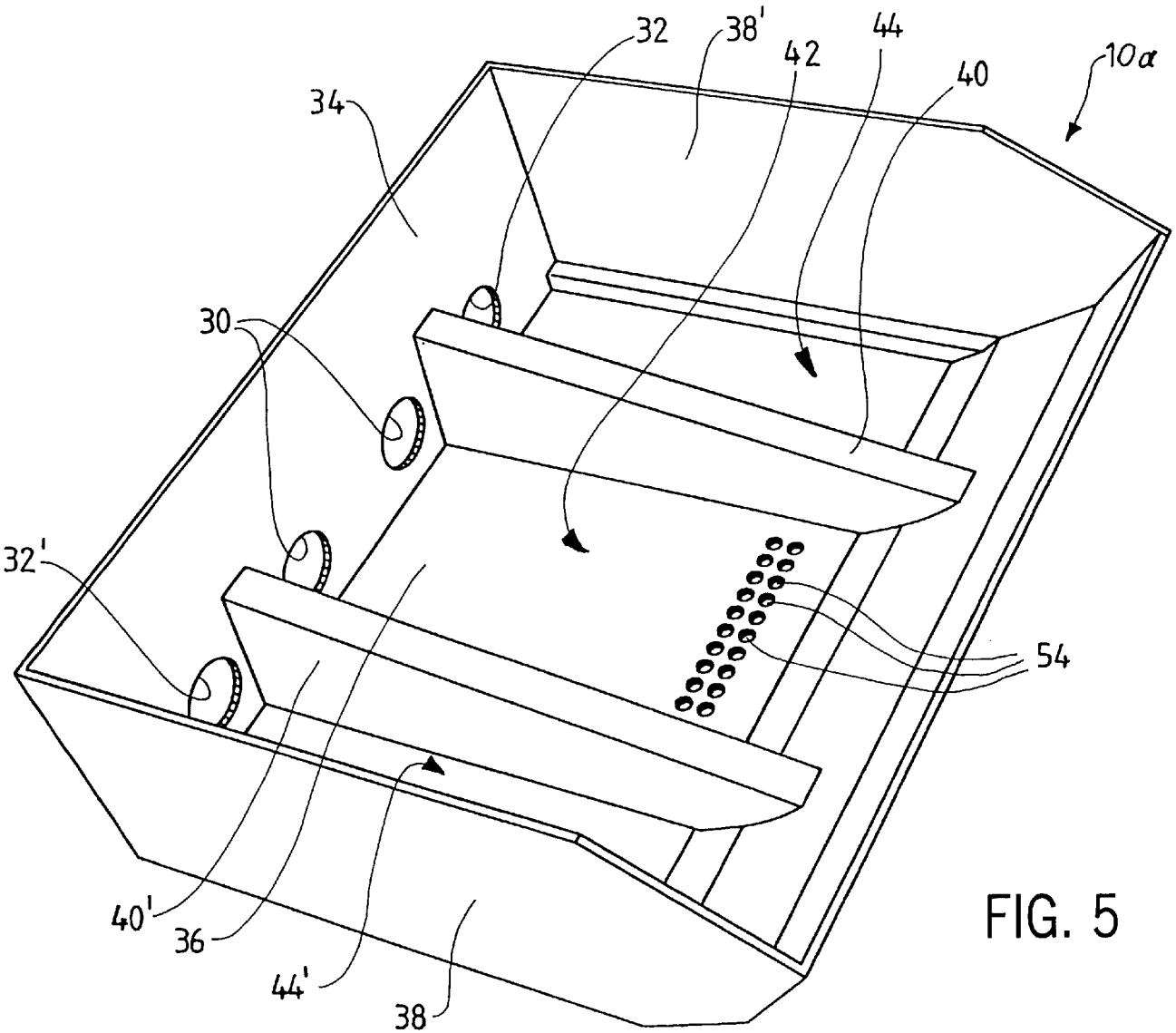
FIG. 5 shows the drawer part in perspective view, seen obliquely from above and from ahead, in order to illustrate the two longitudinal partitions, the through-going holes in the rear wall and the holes adjacent the front edge, between the partitions.

Each drawer, FIGS. 4 and 5, see also lowermost drawer in FIG. 1, is open upwardly, but, in principle, it is sufficient that a front drawer portion is open upwardly and forms the refrigerating counter's take out place for bottles, cans and other goods to be cooled (not shown) which are assumed to be stacked, central axes thereof being oriented in mutually various directions, such that a desired movement in the bottle/can mass takes place when one or more bottles/cans are removed by a customer. Such a higgledy-piggledy stacking of e.g. bottles is known per se, but not in connection with cabinet coolers and similar refrigerating counters/cabinets.

Each drawer is filled with goods to be cooled in the rear area thereof, and these goods gradually "work" their way forwardly within the drawer, forward to the front take out place, due to the fact that goods are removed from the front portion of the drawer, the take out place. The extent of this take out place in the longitudinal direction of the drawers 10 appear from FIG. 1 (four upper drawers—lowermost drawer taking a filling position).

As it appears from FIG. 4, each drawer consists of two separate parts, one drawer part 10*a* and a loose, upper bottom part 10*b*. These parts 10*a*, 10*b* may in one embodiment be formed in one piece, but this will, of course, make the cleaning of the drawers 10 difficult.

The drawer part 10*a*, FIG. 5, has a substantially horizontal bottom 36 and two parallel side walls 38, 38'. In order that an overlying drawer 10 not shall cover too much of the upwardly open, front portion of the underlying drawer, the side walls 38, 38' are chamfered such that they partly slope downwardly in a forward direction in an upper, foremost portion, partly slope downwardly in a rearward direction at a lower, foremost portion.

Two longitudinal, parallel partitions 40, 40' slope downwardly in the drawer part 10*a* in a forward direction and form a support for the overlying, loose bottom part 10*b* which, thus, is allotted a correspondingly inclined course, the slope favouring the movements of the goods to be cooled from rearmost drawer portion towards the front drawer portion, the take out place.

The partitions 40, 40' of the drawer part 10*a* divide the prism-like chamber below the loose bottom lob into three sub chambers 42, 44, 44', each of the two outermost sub chambers 44, 44' being assigned a through-going hole 32, 32' in the rear wall 34, and wherein the central sub chamber 42 is assigned two through-going holes 30 in said rear wall 34.

At the rear portion thereof, the loose bottom part 10*b* of each drawer 10 is provided with two groups of perforations 46 and 46' which are vertically through-going and positioned at opposite side portions, so that they correspond with underlying lateral sub chambers 44, 44' for withdrawal of warmer, "used" cooling air, which is displaced in a rearward direction in the drawer by supplied cold cooling air which, from the central channel 16, FIG. 3, the pipe studs 26 and the through-going holes 30 of the drawer part 10*a* in the rear wall 34, flows into the goods accommodating part of the drawer, said part being defined by upper portions of the drawer part's 10*a* rear wall 34 and side walls 38, 38' as well as the loose bottom 10*b*, through a horizontal row of holes 48 which, thus, are directed rearwardly in the longitudinal direction of the drawer 10.

The front edge of the loose bottom part lob has an approximately inverse V-shaped profile 50, which conducts the cold cooling air coming from the underlying drawer part 10*a* in the desired direction, i.e. rearwardly from the flow out holes 48, thereby effecting a directionally oriented displacement of warmer air which one desires to be removed. By means of the outwardly projecting portions 51, 51' of the bottom part 10*b*, resting against the drawer part 10*a*, cold air supplied thereto is prevented from flowing into the side chambers 44, 44'.

For increased support of the loose bottom part 10*b*, the same has side walls 52, 52' decreasing in height in a forward direction, having the same sloping course as the partitions 40, 40' of the drawer part.

In a foremost portion, the bottom of the drawer part 10*a* has a number of through-going, vertically oriented holes 54, which allow the previously mentioned "leak" of cold cooling air downwards onto the underlying drawer's upwardly open take out place for cooled goods. This downwardly directed cold air flow against the hand of the customer and the underlying goods will cause a pleasant feeling of chilled goods.

I claim:

1. A counter for continuous, direct, cold air cooling of goods to be cooled and dispensed in a cold condition, said apparatus comprising:

a housing;

a cold air supply system having means for providing cold air, means forming a cold air supply channel in said housing for supplying cold air, and means forming at least one air exhaust channel in said housing for removing used air; and at least one drawer mounted in said housing for movement between a retracted position in which the goods are cooled and dispensed and an extended position in which the drawer is supplied with goods, said drawer having a front portion from which cooled goods are removed, said drawer having a rear portion into which goods are supplied, said drawing having a bottom member on an upper surface of which goods placed in the drawer rest, said drawer having a depth such that the drawer may contain goods disposed in a disorderly fashion, said rear portion of said drawer having at least one air admission hole that is in fluid communication with said cold air supply channel when said drawer is in the retracted position, said rear portion of said drawer having at least one air discharge hole that is in fluid communication with said air exhaust channel when said drawer is in the retracted position, said drawer having means forming a plurality of passages beneath said bottom member of said drawer, a first one of said passages passing cold air from said air admission hole to the front of said drawer, a second one of said passages passing used air to said air discharge hole, said drawer having cold air dispensing means in said front portion thereof coupled to said first passage and facing toward said rear portion of said drawer for dispensing cold air above said bottom member and onto goods resting on said upper surface of said bottom member, said bottom member having holes adjacent said rear portion of said drawer connecting to said second passage for returning used air to said second passage, said bottom member sloping downwardly in a direction from said rear portion to said front portion of said drawer, the sloping of said bottom member tending to cause the goods to move toward the front portion of said drawer.

2. A refrigerating counter as set forth in claim 1 wherein said drawer has a bottom under said bottom member, said bottom member being spaced from said bottom, and wherein said drawer has a pair of partition walls in the space between said bottom and said bottom member forming said first passage as a central passage and forming a pair of second passages, one of which lies on either side of said central passage.

3. A refrigerating counter as set forth in claim 2 further including a pair of said drawers mounted one above the other in said housing and wherein an upper drawer of said pair of drawers is further defined as having a plurality of holes in the bottom in the front portion thereof connecting to said central passage for discharging cold air from the bottom of said upper drawer.

4. A refrigerating counter as set forth in claim 2 further defined in that said bottom member has holes adjacent said rear portion of said drawer connecting to each of said second passages.

5. A refrigerating counter as set forth in claim 1 wherein said bottom member comprises a liner for said drawer and wherein said cold air dispensing means is formed in said liner, said liner forming a chamber in said front portion of said drawer between said first passage and said cold air dispensing means extending across the entire width of said drawer.

6. A refrigerating counter as set forth in claim 1 wherein said front portion of said drawer has a sloping member forming a barrier for goods moving toward the front portion of said drawer.

* * * * *